US010376437B2

(12) United States Patent
Talton

(10) Patent No.: US 10,376,437 B2
(45) Date of Patent: Aug. 13, 2019

(54) GAIT ASSIST APPARATUS

(71) Applicant: Jeffrey Scott Talton, Pikeveille, NC (US)

(72) Inventor: Jeffrey Scott Talton, Pikeveille, NC (US)

( * ) Notice: Subject to any disclaimer, the term of this patent is extended or adjusted under 35 U.S.C. 154(b) by 121 days.

(21) Appl. No.: 15/847,885

(22) Filed: Dec. 19, 2017

(65) Prior Publication Data

US 2018/0177673 A1 Jun. 28, 2018

Related U.S. Application Data

(60) Provisional application No. 62/441,385, filed on Jan. 1, 2017, provisional application No. 62/438,455, filed on Dec. 22, 2016.

(51) Int. Cl.

| | |
|---|---|
| ***A61H 3/04*** | (2006.01) |
| *A61H 3/02* | (2006.01) |
| *A63B 21/00* | (2006.01) |

(52) U.S. Cl.

CPC ..... *A61H 3/04* (2013.01); *A61H 2003/0216* (2013.01); *A61H 2003/0283* (2013.01); *A63B 21/154* (2013.01)

(58) Field of Classification Search

None

See application file for complete search history.

(56) References Cited

U.S. PATENT DOCUMENTS

| | | | | |
|---|---|---|---|---|
| 2,903,238 | A * | 9/1959 | Flandrick | A61G 7/1017 212/238 |
| 2,928,675 | A * | 3/1960 | Nawara | A63B 21/154 482/133 |
| 3,481,198 | A * | 12/1969 | Williams | A63B 21/0083 482/112 |
| 4,029,311 | A * | 6/1977 | Chanslor | A61H 3/04 482/68 |
| 9,016,297 | B2 * | 4/2015 | Salomon | A45B 1/02 135/66 |
| 9,132,056 | B2 * | 9/2015 | Westerlund | A61H 3/04 |
| 9,649,243 | B2 * | 5/2017 | Johnson | A63B 69/0064 |
| 2006/0248649 | A1 * | 11/2006 | Kuenzel | A61G 5/006 5/618 |
| 2017/0165146 | A1 * | 6/2017 | Franson | A61H 3/04 |

* cited by examiner

*Primary Examiner* — Stephen R Crow
(74) *Attorney, Agent, or Firm* — Robert J. Hess

(57) ABSTRACT

A gait assist apparatus having assemblies for a chassis, shock absorption, swivel wheel (casters), pivot, crutch and spring tension. The crutch is fitted onto an upper shaft of a pivot housing to pivot relative to the chassis. A pair of topside tension springs extend from a shock absorption plate to the middle of the crutch. A pair of underside tension springs extends from the bottom end of the crutch to the underside of the chassis. Suspension springs space the shock absorption plate above the chassis. One of the underside tension springs possesses a tension/compression force greater than that of the other tension springs. One of the topside tension springs possesses a tension/compression force greater than that of the other topside tension springs.

20 Claims, 5 Drawing Sheets

GAIT ASSIST APPARATUS

CROSS-REFERENCE TO RELATED APPLICATIONS

The present application is accorded the benefit of invention priority from provisional patent application No. 62/438,455 filed Dec. 22, 2016 and from provisional patent application No. 62/441,385 filed Jan. 1, 2017

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

According to the 2010 Americans with Disability report from the U.S. Census Bureau, roughly 30.6 million individuals aged 15 years and older (12.6% of the U.S. population) had limitations associated with ambulatory activities of the lower body including difficulty walking. About 23.9 million people (9.9% of the U.S. population) had difficulty walking a quarter of a mile, including 13.1 million who could not perform this activity. This represents a significant healthcare, societal and economic problem as these people are at significant risk of developing co-morbidities, rapidly declining health, and face significant challenges associated with integrating into the community and re-joining the workforce. Neurological disorders such as Parkinson Disease ("PD") and stroke are significant contributors to this large and growing segment of the population. An estimated 5 million people throughout the world have PD with about one million living in the United States and the number of individuals with PD is expected to double from 2005 to 2030. Every year, more than 795,000 people in the United States have a stroke, with approximately 87% of these strokes being ischemic (thrombotic and embolic). The 30 day mortality following an ischemic stroke is approximately 10%, meaning that the remaining 90% live with disabilities, resulting in upwards of 7 million stroke survivors living in the United States today. The costs of these two diseases to the United States are significant, with estimated annual costs of $38.6 billion for stroke and $23 billion for Parkinson Disease. Disorders, such as muscular dystrophy, polio, multiple sclerosis (MS), amyotrophic lateral sclerosis (ALS), spinal cord injury, cerebral palsy, or age-related deterioration also present varied degrees of mobility impairment. Some disorders, such as ALS, present issues of progressive mobility impairment that change and worsen over time.

As to stroke patients, many patients are capable of ambulation, but struggle with slow, fatigue-inducing gait patterns resulting from weakened ankle dorsiflexion and plantar flexion, as well as reduced movement during hip flexion and extension. Persons recovering from ischemic stroke in the middle cerebral artery (MCA) often suffer from diminished lower-extremity abilities, exhibiting hemiparesis and limited endurance.

Patients who have suffered severe lower extremity trauma (including polytrauma) will often undergo major reconstructive surgery to repair damaged skeletal and soft tissue (including peripheral nerves) in an effort to enable them to ambulate independently. Other mechanisms of injury that affect patient mobility are mild TBI (loss of coordination movement), severe TBI (loss of muscle force generation capacity), stroke and other neuromuscular disorders.

A pressing need exists for effective interventions for persons with mobility impairments, including impairments resulting from, but not limited to, Parkinson's disease, stroke, muscular dystrophy, polio, multiple sclerosis (MS), amyotrophic lateral sclerosis (ALS), spinal cord injury, cerebral palsy, and/or age-related deterioration. Taking impairments resulting from PD and stroke as illustrative examples, these diseases have different underlying causes and presentations, yet present similar co-morbidities and consequences on quality of life. Despite medical and surgical interventions for PD patients, they face deterioration in mobility over time resulting in a loss of independence and a decline in health related quality of life (HRQoL). Deterioration of walking is perhaps the most important single factor contributing to decline in HRQoL. In one study, a significant decrease (12%) in the number of steps (effect size=0.28) walked per day over the course of one year highlights the rapid decline in walking ability that occurs with disease progression. In stroke, an infarction in the middle cerebral artery (MCA) is the most common site of cerebral ischemic. Most persons regain some ability to ambulate following physical therapy; however, they often require rigid braces (ankle-foot orthoses) and various forms of assistive devices (i.e., walkers and canes), which limit walking efficiency. Walking is slow, labor intensive and inefficient, with most persons post-stroke ambulating slower than about 0.8 meters/second.

Such limited walking speeds after stroke can restrict individuals to the household and limit reintegration into the community. It is therefore not surprising that the restoration of walking function is the ultimate goal of rehabilitation for the majority of stroke survivors and the focus of much rehabilitation research. However, current therapies are often unable to improve subjects' community ambulation status, regardless of the mode or sophistication of the training as walking deficits persist for most patients. Community-based rehabilitation programs have been proposed to address the limitations of the clinic-based model; however, an evaluation of community-based outcomes demonstrates mixed results with subjects remaining largely sedentary. A simple explanation for this is that many of these programs rely heavily on patient education and motivational feedback (e.g. daily step counts) to improve physical activity and do not address the specific motor impairments limiting mobility. Consequently, these programs tend to neglect the real impact that an impaired motor system has on an individual's walking ability and community engagement.

Beyond slowed walking speeds, post-stroke gait can also be characterized by altered kinematics and kinetics in both magnitude (e.g., joint angle range, peak moment, peak power) and pattern (e.g., shape and direction of curves). These deficits are more marked on the paretic side; however both limbs are often impaired. There are indications that impaired improvements in gait mechanics contribute to a higher reduced energy cost of walking and improved reduced long-distance walking ability after stroke, major factors limiting determinants of community engagement. Indeed, a hallmark of post-stroke walking is the use of inefficient compensatory strategies, such as stiff-legged and circumduction gait, to advance the body through space. Because a rapid achievement of walking independence—not necessarily the reduction of impairment—is the goal of current neuro-rehabilitation practice, the prevalence of such compensatory strategies following rehabilitation is not surprising as gains in walking function are achievable via compensatory mechanisms.

Furthermore, current assistive devices such as canes and walkers, which are often provided during the early phases of stroke recovery to promote safe, independent ambulation, may also contribute to this reliance on compensation. Considering that compensatory strategies are known to increase the energy cost of walking, increase the risk of falls, reduce endurance, and reduce speed, gains in walking independence through such mechanisms may impose bounds on the degree of community reintegration possible after stroke. The impact on post-stroke physical activity of such walking deficits is evidenced in a markedly reduced total number of steps walked per day compared to even the most sedentary healthy adults. Given that reduced physical activity increases the risk of second stroke, heart disease, diabetes, hypertension and depression, and is further associated with a reduced health-related quality of life, a need exists for the development of interventions that directly modify walking ability in a manner that facilitates long term improved physical activity, ultimately building healthier lives for persons after stroke.

A chief limitation of the current rehabilitation model is that training and evaluation often occur in the confines of the clinic and are often divorced from the constraints and demands of a patient's home and daily environment. For example, recent intervention studies have demonstrated marked improvements in clinic-measured walking speed without concurrent translation of these improvements in community ambulation. Beyond poor ecological validity, current efforts are also limited by logistical and economic constraints. For example, current reimbursement models are such that after a stroke, patients only receive physical therapy in outpatient centers for 10-12 weeks, after which individuals typically do not participate in a rehabilitation program. During these 10-12 weeks, the frequency of therapy is often limited to only 3-5 sessions per week. Thus, subjects may amass between 30 to 60 total sessions during the course of their rehabilitation—with much, if not all, taking place in environmental contexts substantially different than what they encounter on a daily basis. Despite rehabilitation efforts, marked physical inactivity is emblematic of persons post-stroke and continues to worsen across the first year after occurrence. Thus, effective interventions focused on improving mobility (e.g., restoring more natural motion) for an affected patient having a gait impairment or disorder is a significant factor in reducing their disability, improving integration with the community and improving HRQoL.

Difficulty with walking is frequently followed by problems with gait-dependent activities such as housework, dressing, transferring in and out of bed. For patients with neurological disorders, limited gait velocity commonly results in walking that is predominantly restricted to the household with limited reintegration into the community.

The clinical hallmarks of Parkinson disease include resting tremor, rigidity (i.e., stiffness), bradykinesia (i.e., slowness of movement) and gait disturbance. Pathologically, PD is characterized by degeneration of dopaminergic neurons in the substantia nigra of the midbrain. As a result of this deficiency, there is a loss of the normal internal cueing mechanism resulting in lack of automaticity and synchronization of movement. This contributes to the characteristic gait of persons with PD—impaired regulation of stride length, reduced gait speed, altered cadence and stride time variability. This is in part due to a decreased rate of torque generation in the plantar flexors during terminal stance. Dopamine replacement therapy, the gold standard pharmacological treatment in PD, is ineffective in remediating step frequency and gait variability.

A stroke patient's gait is characterized by a decrease in self-selected speed and previous studies have reported altered kinematics and kinetics in both magnitude (e.g., joint angle range, peak moment, peak power) and pattern (i.e., shape and direction of curves). In addition, while there are reported reductions in both legs, there is typically a greater reduction on the paretic side. Compared to healthy adults, walking patterns post-stroke are also commonly associated with greater physiological effort during walking. One of the primary factors contributing to these abnormal walking patterns in persons post stroke in the MCA distribution is the impaired functions of the distal limb musculature (e.g., ankle joint plantarflexors or calf muscles) of the involved paretic leg.

For all these conditions, a challenge for caregivers is to restore a patient's physical function in order to minimize the delay they face for returning to normal activities while they complete a rehabilitation program, which can typically be expected to take 3-6 months. The medical consequences of restricted mobility are staggering. Complications associated with immobility affect the musculoskeletal system (e.g., atrophy, osteoporosis, etc.), respiratory system (e.g., pulmonary embolism, decreased ventilation, etc.), vasculature (e.g., deep vein thrombosis, etc.), skin (e.g., pressure sores, tissue breakdown, infection, etc.) and the patient's mental state.

Conventional wheelchairs are often employed to help individuals to move. However these offer little benefit in terms of exercise for the legs of the user. To exercise the legs, walkers are frequently used, which users are able to lean on and hold on to as they move about. Walkers such as these cause upper body strain, as the user often must lean heavily on the handles of the walker in order to reduce his or her weight enough to move without severe discomfort. Therefore, there is a need to change this paradigm such that a user need not rely heavily on leaning on a walker in order to move without discomfort. Approaches that make provision for an external source of power (i.e. motorized wheels) that would propel the patient horizontally ignore any potential rehabilitative, therapeutic effects by leaving the patient out of the propulsion process.

Indeed, mobility aids were designed as a means of assisting individuals that experienced decreased leg strength or deformities; however, during the recovery process of these individuals, durable medical equipment companies most often supplied them with either the conventional handheld walker, rolling walker, walking cane, or crutches individually, but none of those devices were capable of supplying the assistance required for the rehabilitation of weak legs when so many other areas of the body needing support was totally neglected. Originally, these devices were thought to give sufficient stability and support; however, since an adequate sense of balance, strength in the arms, legs, wrists and back areas are also required to operate these devices, the individual using these devices would soon become exhausted and limit their activities of exercise resulting in prolonged rehabilitation.

A walker, as a mobility aid has stability due to the construction of the base, but since the stability feature of that walker is limited to stabilizing the walker and not the individual user, it is not sufficiently accommodating alone to provide adequate assistance in the mobilization of an individual. The resulting effects generally produced significant postural and back problems or injury due to the lack of proper body alignment and support.

Crutches, have a definite advantage over a walker, because they provide more contact points between the device and the individual user, wherein means to relieve stress from the back areas and weight off the legs is provided. But crutches alone hinder the endurance of the weak, because most of the individuals energy is used lifting the crutches with each step taken.

Whether a mobility aid is built for walking, standing or to minimize the ambulatory efforts of the individual user, safety should always be considered a crucial factor during production and selection of a device. There are rolling platforms, canes and walkers that seek to help movement of persons having limited mobility who can remain in an upright, standing position.

U.S. Patent Application Publication No. 2013/0197,407 provides for a system for gait training, which includes a height-adjustable rolling platform for attaching to the foot with or without a shoe, on the affected side of a subject. When the subject shifts their body weight away from the affected side, the platform is capable of forward and backward movement to follow the swinging movement of the leg. When the subject shifts their body weight to the affected side, a passive braking system arrests any further movement of the affected limb.

U.S. Pat. No. 9,016,297 provides for a quad-wheeled and quad-legged cane. The cane typically includes one or more wheels, one or more rigid supporting structures, and one or more handles. The wheels of the cane are preferably retractable. The rigid support structures preferably overhang the wheels and generally provides fail-safe braking. The handles may be adjustable U.S. Pat. No. 4,029,311 provides for an invalid walker having a lightweight, rigid frame having improved steerability derived from a combination of uniquely steerable front casters having upwardly and forwardly slanted swivel shafts together with non-swiveling rear wheels that are independently and separately controlled by separate right and left-hand brakes. Simple, effective brakes for each wheel embody a tubing section held in place solely by a return spring and the hand-operated brake cable.

U.S. Pat. No. 9,132,056 provides a crutch with wheels and a frame structure with a straight front frame part, a curved rear frame part and a strut extending between the straight front frame part and the curved rear frame part. A handle is provided in the upper part of the front frame part and a wheel is provided in the lower part of the front frame part. The upper part of the rear frame part is connected to the front frame part and a pair of wheels is provided in the lower part of the rear frame part. A tubular part is fixed to the lower part of the handle, which tubular part is detachably insertable into or over the upper end of the front frame part and in that a lower part of the tubular part is designed for connection to a ferrule when the handle is withdrawn from the front frame part.

U.S. Pat. No. 5,62,762 provides a walker with a non-rotatable glide assembly that easily slides over the ground surface when a walker is lifted and advanced forwardly. As soon as a predetermined downward force is exerted on the walker legs, the glides retract and non-slip crutch tips engage the ground surface. Moreover, an individual glide may be easily removed and substituted by a wheel that provides rolling contact with the ground surface. The remainder of the mounting structure is used so that the walker may be easily converted from a glide to wheeled arrangement.

BRIEF SUMMARY OF THE INVENTION

One aspect of the invention resides in a gait assist that provides a new form of sport. Another aspect resides in the gait aspect providing ergonomic benefits by removing some of the body weight normally supported by the legs by redirecting it to the arms and shoulders. The person still receives all the benefits from walking, but the legs now have less weight to support.

The gait assist helps a person to walk as normal as possible. The arms of the person should be able to swing and move about as freely as possible. To achieve this, the front wheels of the gait assist swivel and a crutch is placed onto the gait assist to essentially pivot back and forth. The gait assist weight is kept as low as possible to ground level to minimize any resistance to arm movement.

The gait assist of the present invention is used with forearm crutches. It has four purposes:

1) To assist in walking by shifting weight from legs to arms.
2) To help people walk and exercise that have leg, knee and foot problems.
3) To create an additional form of exercise.
4) To create an additional sporting activity.

The gait assist of the present invention preferably provides these attributes:

1) Shock absorption with two wheels per crutch. The front wheel or front caster pivots and the back wheel or back caster does not (is fixed to remain inline without pivot capability).
2) The crutch is secured in a manner to enable pivoting back and forth freely. It is spring assisted for safety, maneuverability and comfort (the latter arising from sensing positive feedback via the springs from locomotion).

BRIEF DESCRIPTION OF THE SEVERAL VIEWS OF THE DRAWING

For a better understanding of the present invention, reference is made to the following description and accompanying drawings, while the scope of the invention is set forth in the appended claims.

DETAILED DESCRIPTION OF THE INVENTION

Figure 2:
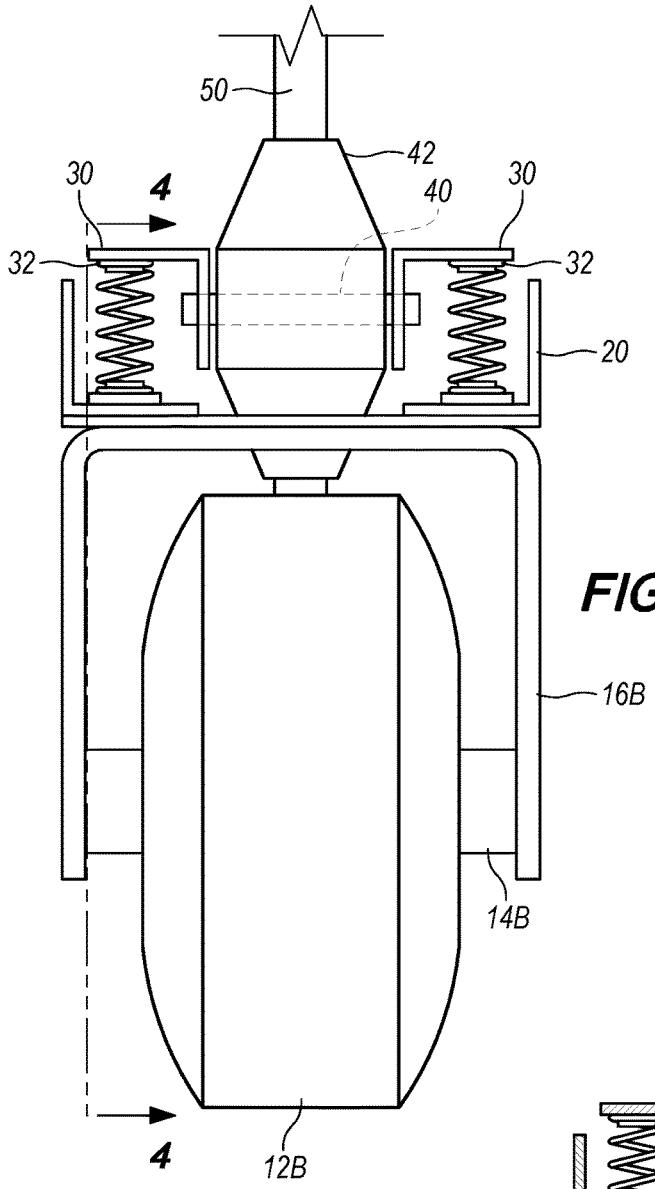
FIG. 2 is an end view taken across line 2-2 of FIG. 1.
Figure 3:
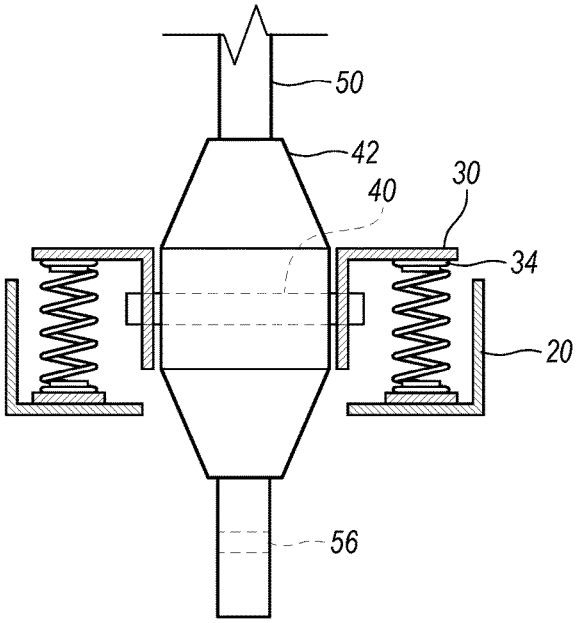
FIG. 3 is a section view taken across line 3-3 of FIG. 1.
Figure 4:
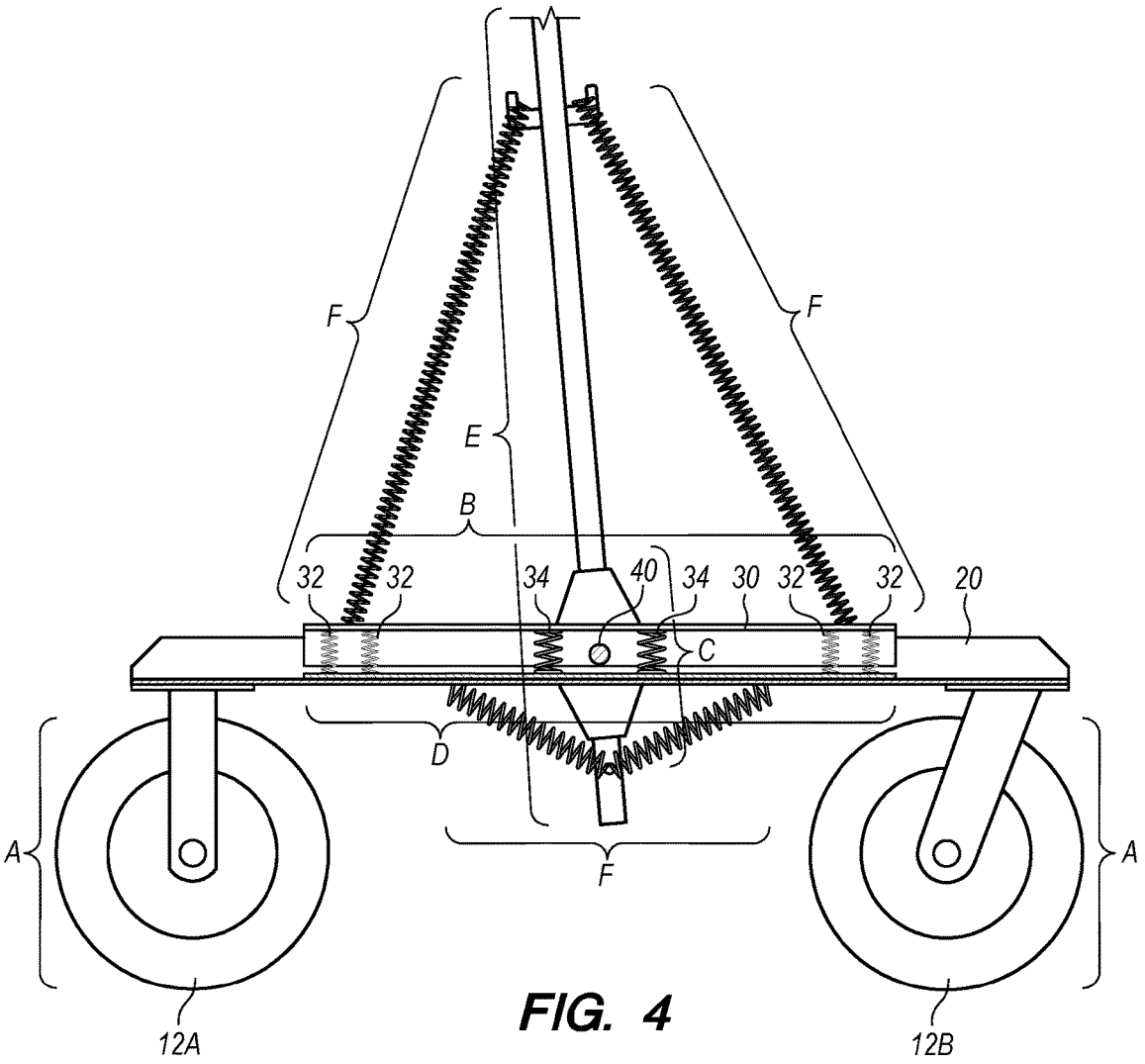
FIG. 4 is a section view taken across line 4-4 of FIG. 2.
Figure 5:
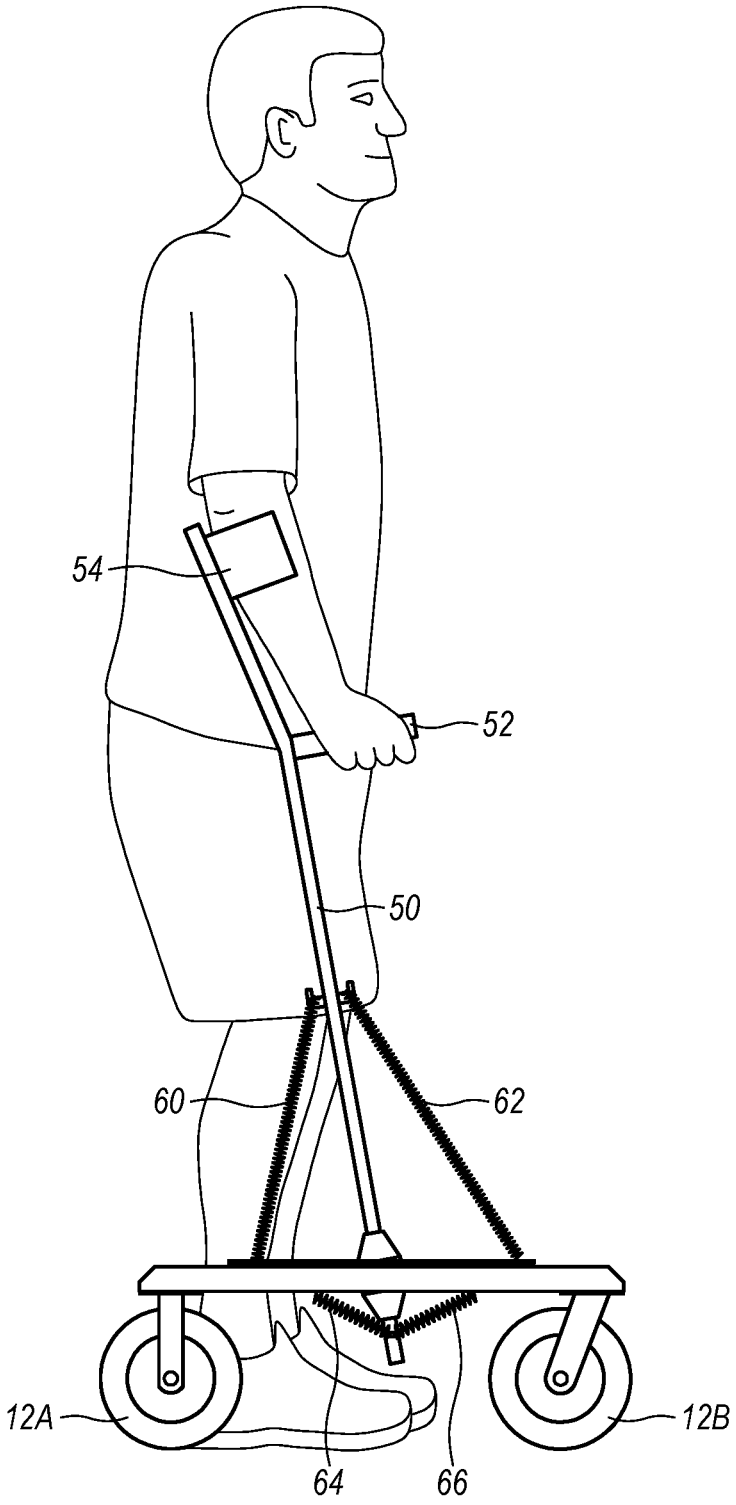
FIG. 5 is an upright view of FIG. 1 in use by a person.
Figure 6:
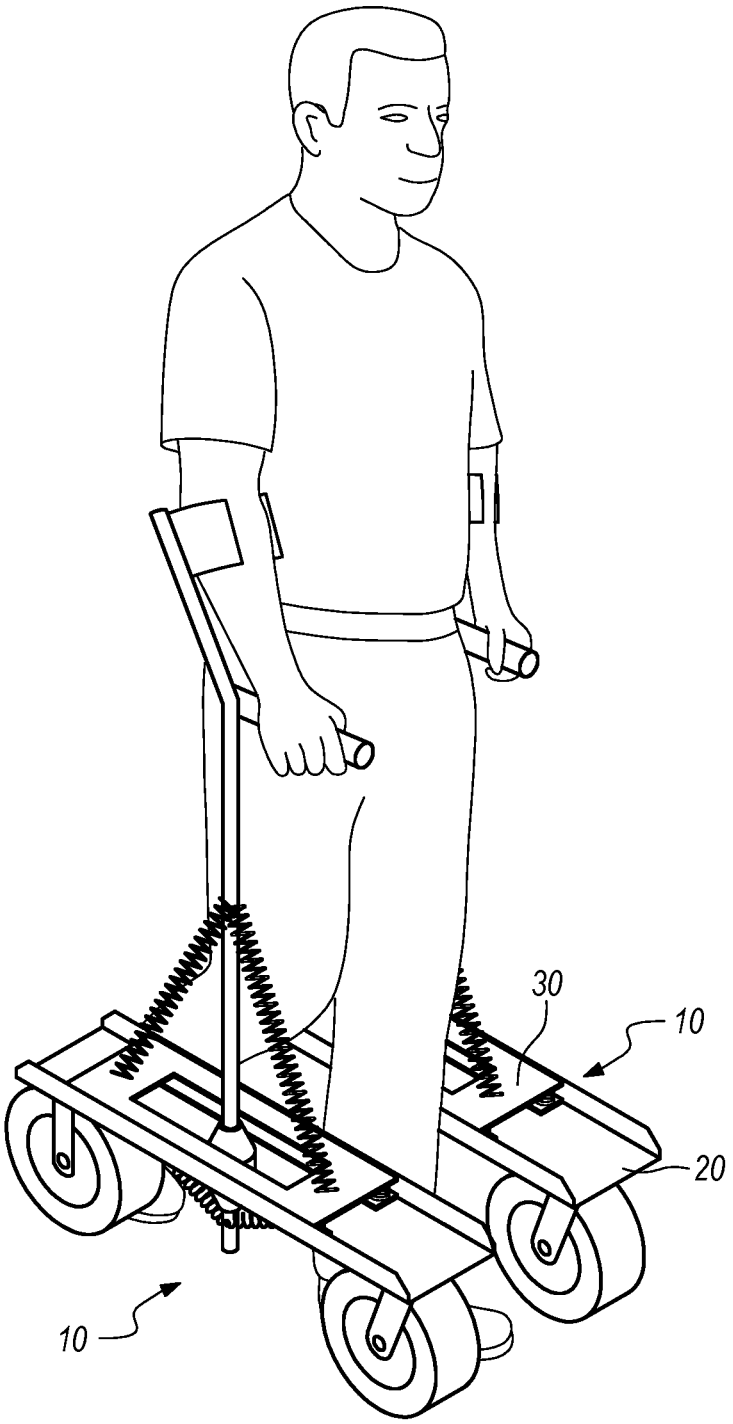
FIG. 6 is an isometric view of two of the gait assists of FIG. 1 in use by a person.

Turning to the drawing, FIGS. 1-4 illustrate the structure of the gait assist 10 in accordance with the invention and FIGS. 5 and 6 illustrate use of the gait assist by a person. Turning to FIGS. 4 and 6, the gait assist 10 includes a caster wheel assembly A, a chassis assembly B, a pivot mechanism C, a suspension assembly D, a pivoted assembly E and a spring tension assembly F. The castor wheel assembly includes a front swivel wheel or caster and a rear fixed wheel or caster.

Caster Wheel Assembly A

Figure 1:
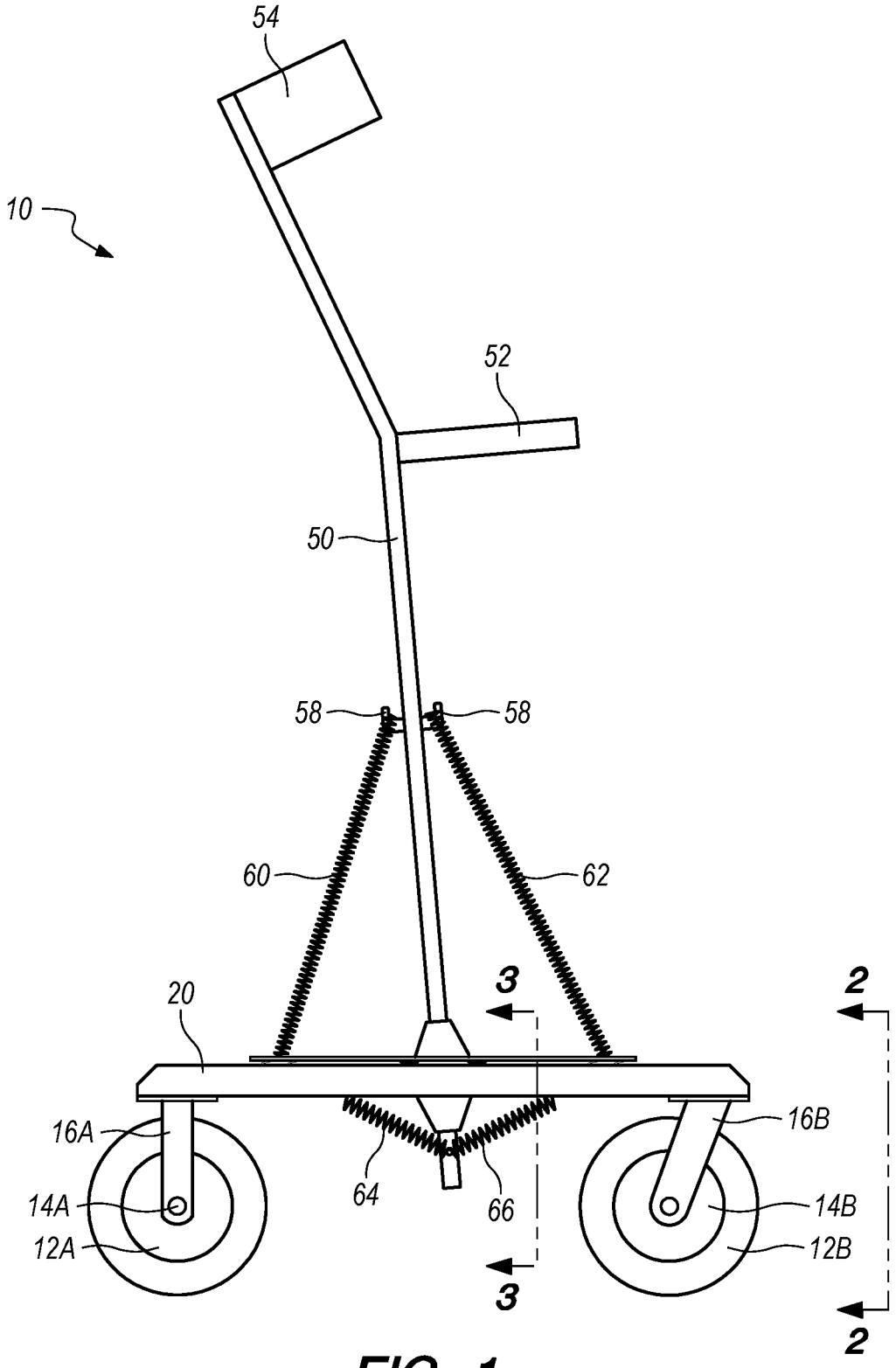
FIG. 1 is an upright view of the gait assist in accordance with the invention.

Turning to FIGS. 1 and 2, caster 12A is a swivel wheel and caster 12B is a fixed wheel. Both are spaced apart with each having a respective axle rod 14A, 14B passing through respective axial centers of the two casters 12A, 12B. The opposite ends of the axle rods 14A, 14B are secured to a respective pair of wings of a respective U channel 16A, 16B, which is angled as shown.

Chassis Assembly B

As best seen in FIG. 6, the chassis 20 is a U channel. The U channels 16A, 16B each have a respective middle section between their pair of wings that is secured to an underside of the chassis 20.

Pivot Mechanism C

Turning to FIG. 2, a pivot rod 40 passes through opposite sides of a pivot housing 42. One end of the pivot rod 40 is welded to the suspension plate 30 and the opposite end of the pivot rod 40 is inserted into an opening in the suspension plate 30. A plastic sleeve (not shown) passes through the aligned apertures in the pivot housing 42 and the pivot rod 40 is fitted into this plastic sleeve. Although FIGS. 2 and 3 show opposite ends of the pivot rod 40 passing through respective aligned openings in depending legs of the suspension plate 30, it is preferred that one end of the pivot rod 40 be welded to the suspension plate 30 to provide rigidity and prevent the pivot rod 40 from falling out of the aligned apertures of the pivot housing 42 during use because of jostling motion.

Suspension Assembly D

Turning to FIGS. 4 and 6, a suspension plate 30 is secured to the recessed topside of the base of the chassis 20 by a series of shock absorbing suspension springs 32, 34 (FIGS. 2, 3, 4 and 6). The suspension plate 30 has an elongated opening as best seen in FIG. 6 that allows the crutch 30 to pivot back and forth without pressing against the suspension plate 30. The suspension springs 34 have a greater compressive force than the suspension springs 32. The suspension spring allow the user's shoulders to move p and down during locomotion using the gait assist 10. The suspension springs provide shock absorption to the user during locomotion while using the gait assist 10. The suspension springs 32 and 34 may be secured between the chassis 20 and the suspension plate 30. The suspension springs 34 are proximal the pivot housing 42 and closer to the pivot housing 42 than the suspension springs 32, which are distal from the pivot housing 42 since they are further away.

With reference to FIG. 6, the suspension plate 30 is preferably formed from a flat sheet and then two transverse cuts are made and one longitudinal cut is made centrally between the two transverse cuts and then the two cut portions form two L-shaped channels as shown in FIG. 3. In order to retain each of the suspension springs 32, 34 to the chassis 20 and the suspension plate 30, the ring shaped ends of each suspension spring 32, 34 may be fitted onto two circular projections that are each welded in position on the chassis 20 and the suspension plate 30 as applicable. Clamp brackets are used to pass through an open helix portion of the spring just over the applicable circular projection and its ends fastened to the chassis 20 or suspension plate 30 as the case may be. The clamp bracket therefore has two end regions and a central region between with a respective bend separating the central region from each of the two end regions so that the central region extends in a different plane than that of the two end regions. The clamp brackets thus keep the end of the suspension springs 32, 34 from coming off the circular projections.

Pivoted Assembly E

Turning to FIG. 1, the crutch 50 may be any conventional crutch, which are angled as shown under static condition. The crutch 50 has a hand grasp 52 and an arm grasp cuff 54. The base of the crutch 50 slides onto the crutch support bar of the upper shaft (not shown) of the pivot housing 42 in accordance with the invention. Turning to FIG. 3, the pivot rod 40 passes through aligned openings of the pivot housing 42. During use, both the hand grasp 52 and the arm grasp cuff 54 together provide two spaced apart locations for exerting a manual force to urge the walk assist to move. Preferably, the arm grasp cuff 54 is positioned for accommodating the forearm within the cuff.

Spring Tensioned Assembly F

Turning to FIG. 1, there are tension springs 60, 62, 64, 66 that help stabilize the gait assist 10 about its pivot rod 40. The springs 60, 62 extend from opposite end regions of the suspension plate 30 to the crutch 50 at an elevation below the arm grasp rod 52 of the crutch 50 by having one looped end of the springs 60, 62 fitted onto hooks 58 that extend from a conventional clamp (not shown) that is clamped about a portion of the crutch 50. Such a conventional clamp may have two complementary pieces each with a semicircular central region and two outward arms extending in opposite directions—each arm is secured to its counterpart with the two semicircular central regions bolted together about the circumference of the crutch 50. The opposite looped end of the springs 60, 62 is fitted onto respective hooks (not shown) that extend from the suspension plate 30 and are substantially the same construction as the hooks 58. The springs 64, 66 are fastened at one end to the underside of the chassis 20 in any conventional manner such as with bolts and fastened at the opposite end by looping through the hole 56 of the lower shaft of the pivot housing 42 at a location below the chassis 20.

The spring 66 has the greatest stretch resistance, followed in decreasing order of stretch resistance by springs 62, 60 and 64 in that order. To accommodate future features or additions to the gait assist 10 the inventor has found it essential to employ spring 66 as a single, heavy duty spring, to divide spring 64 into two light duty springs, to divide spring 62 into two medium duty springs, and to divide spring 60 into one medium duty and to one light duty spring. The terms heavy duty, medium duty and light duty are relative terms with respect to each other. The heavy duty spring has greater stretch resistance than a medium duty spring, which in turn has greater stretch resistance than a light duty spring.

With reference to FIGS. 5 and 6, during such forward pivoting motion of the crutch 50, tension spring 62 and 64 loses their tension and thus offers less stretch resistance, because they are being compressed. Such forward pivoting motion may arise during the user's arm swinging forward during their normal gait while walking or running. On the other hand, the tension springs 60 and 66 exert a greater tension resistance force during such forward pivoting motion of the crutch. While the user overcomes this tension resistance force to an extent, this tension resistance force will assist the user during the user's arm swinging backward after finishing their forward arm swinging movement.

During the user's swinging backward movement, the spring tension of the springs 60, 62, 64, 66 will balance out when the arm aligns with the user's body. As the user continues to swing his/her arm back, however, springs 62, 64 exert their stretch resistance tension as the crutch 50 pivots backwardly counterclockwise, but springs 60, 66 effectively lose theirs as they compress.

While the user overcomes the tension force exerted by the spring 62 and 64 during the user's rearward arm swinging motion, this tension force aids the user when the user swings their arm once again forwardly.

The forward movement of the gait assist 10 is made easier because the static position of the crutch is angled back from the center due to the different tension strengths and placement of the springs 60, 62, 64 & 66. This angle helps the user overcome the inertia and rolling friction of the gain assist 10. As the user presses down on the handles by exerting a force, some of the force is directed forward due to this angle. The low center of gravity of the gait assist 10 enables the crutch to pivot back and forth while maintaining a forward motion.

The gait assist is made with a chassis spring shock absorbing suspension and may be used with standard/conventional forearm crutches.

The gait assist 10 feels comfortable when two are used as shown in FIG. 6—one for each arm. With reference to FIG. 4, this is achieved because of the tension spring assembly F that is between the crutch 50 and the shock absorbing system D built into the chassis 20 of the gait assist 10 and between the pivot mechanism C and the chassis assembly B. Collectively, the crutch 50, the pivot housing 42 including its upper and lower shafts, constitute the pivoted assembly E that all pivot in unison via the pivot mechanism C.

Turning to FIG. 6, front wheels (or front casters) swivel while the rear ones do not. This wheel/caster configuration provides a maneuverable and stable platform for the chassis 20.

A conventional hand operated friction brake (not shown) may be provided for the rear wheels or rear casters of FIG. 6. Such a conventional hand operated friction brake may include three main components: a squeezing brake lever for the user to apply the brakes; a mechanism for transmitting that signal, such as Bowden cables, and the brake mechanism itself, such as a pivoting L-piece to press against the rear wheel. A Bowden cable is a type of flexible cable used to transmit mechanical force or energy by the movement of an inner cable relative to a hollow outer cable housing.

The gait assist static angle of inclination positions the user back slightly from its center pivot. This keeps the gait assist 10 just ahead of the user.

The gait assist has a proven design made with these features incorporated into it. It can be completely disassembled to replace any part. It is made from steel.

The crutch 50 has a hollow bottom end fitted onto the upper shaft (not shown) of the pivot housing is cylindrical and of smaller diameter than the bottom end of the crutch 50 and projects from the pivot housing 42. In that way, the bottom end of the crutch 50 could be slid or fitted onto the upper shaft (not shown) of the pivot housing and be flush with a top edge of the pivot housing 42. Such an upper shaft [not shown] of the pivot housing 42 preferably extends to the elevation of the tension springs 60 and 62.

The inventor was given permission to use the gait assist 10 in the 2017 New Jersey and 2017 Marine Corp marathons. The gait assist 10 completed both of these marathons without any safety or mechanical issues. Its inventor has had total knee replacement surgery.

While the foregoing description and drawings represent the preferred embodiments of the present invention, it will be understood that various changes and modifications may be made without departing from the scope of the present invention.

What is claimed is:

1. A gait assist apparatus, comprising: a chassis; a shock absorbing assembly supported by the chassis, the shock absorbing assembly including a shock absorbing plate and suspension springs between an underside of the shock absorbing plate and the chassis; a pivot mechanism that includes a pivot rod and a pivot housing, the pivot housing being arranged to pivot about the pivot rod; and tension springs that are supported by at least one of the shock absorbing plate and the chassis to alternatively stretch and compress in dependence upon a relative orientation of the pivot housing with respect to the chassis and the shock absorbing plate during pivoting motion about the pivot rod, the tension springs including a topside pair supported by the shock absorbing plate and an underside pair supported by the chassis; a wheel assembly for supporting the chassis in a manner that enables the chassis to roll back and forth via the wheel assembly upon a surface.

2. The gait assist apparatus of claim 1, wherein said wheel assembly further comprises a swivel wheel assembly having two casters.

3. The gait assist apparatus of claim 2, further comprising:

a crutch connected to the pivot housing, which in turn is connected to the shock absorption plate via the pivot rod, the crutch having a hand grasp rod and an arm grasp cuff spaced from each other, the topside pair of tension springs being attached to the crutch at a location that is between a location of the pivot rod and a location of the hand grasp rod, the underside pair of tension springs being attached at a location beneath the chassis.

4. The gait assist apparatus of claim 3, wherein one of the tension springs of the topside pair possesses a greater spring tension force than that of a remaining one of the topside pair, the crutch having a top end that inclines, the one of the tension springs of the topside pair being beneath an incline of the top end of the crutch, the hand grasp extending in an outward direction with the remaining one of the tension springs of the topside pair being beneath the hand grasp.

5. The gait assist apparatus of claim 4, wherein one of the tension springs of the underside pair possesses a greater spring tension force than that of a remaining one of the underside pair and being beneath the one of the tension springs of the topside pair, the remaining one of the tension springs of the underside pair being beneath the remaining one of the tension springs of the topside pair.

6. The gait assist apparatus of claim 5, wherein the one of the tension springs of the underside pair possesses the spring tension force that is greater in magnitude than that possessed by the tension springs of the topside pair.

7. The gait assist apparatus of claim 1, wherein one of the tension springs of the topside pair possesses a greater spring tension force than that of a remaining one of the topside pair.

8. The gait assist apparatus of claim 7, wherein one of the tension springs of the underside pair possesses a greater spring tension force than that of a remaining one of the underside pair and being beneath the one of the tension springs of the topside pair, the remaining one of the tension springs of the underside pair being beneath the remaining one of the tension springs of the topside pair.

9. The gait assist apparatus of claim 1, wherein the one of the tension springs of the underside pair possess the spring tension force that is greater in magnitude than that possessed by the tension springs of the topside pair.

10. The gait assist apparatus of claim 1, wherein the pivot rod extends through aligned openings of the pivot housing.

11. The gait assist apparatus of claim 3, wherein the pivot rod extends through aligned openings of the pivot housing.

12. The gait assist apparatus of claim 11, wherein the shock absorbing plate has a flat portion that extends in a plane and two leg portions that extend in respective planes that are transverse to the plane that the flat portion extends, the shock absorbing plate having two bent portions between the two leg portions respectively and the flat portion so as to define a central opening bounded by the two bent portions and by two opposite edges that extend between the two bent portions, the chassis having a base with a central opening in alignment with the central opening in the shock absorbing plate, the pivot housing being between the two leg portions.

13. The gait assist apparatus of claim 1, wherein the shock absorbing plate has a flat portion that extends in a plane and two leg portions that extend in respective planes that are transverse to the plane that the flat portion extends, the shock absorbing plate having two bent portions between the two leg portions respectively and the flat portion so as to define a central opening bounded by the two bent portions and by two opposite edges that extend between the two bent portions, the chassis having a base with a central opening in alignment with the central opening in the shock absorbing plate.

14. The gait assist apparatus of claim 1, wherein one of the tension springs of the topside pair possesses a greater spring tension force than that of a remaining one of the topside pair.

15. The gait assist apparatus of claim 1, wherein one of the tension springs of the underside pair possesses a greater spring tension force than that of a remaining one of the underside pair.

16. The gait assist apparatus of claim 14, wherein one of the tension springs of the underside pair possesses a greater spring tension force than that of a remaining one of the underside pair and being beneath the one of the tension springs of the topside pair, the remaining one of the tension springs of the underside pair being beneath the remaining one of the tension springs of the topside pair.

17. The gait assist apparatus of claim 1, wherein the one of the tension springs of the underside pair possesses the spring tension that is greater in magnitude than that possessed by the tension springs of the topside pair.

18. The gait assist apparatus of claim 1, wherein the suspension springs include a proximal set of the suspension springs and a distal set of the suspension springs, the proximal set being closer to the pivot housing than is the distal set, the proximal set having a greater compression force than that of the distal set.

19. The gait assist apparatus of claim 1, wherein the tension springs include a heavy-duty tension spring, three medium-duty tension springs, and three light-duty tension springs, the heavy-duty tension spring having a greater stretch resistance than any of the three medium-duty tension springs, any of the three medium-duty tension springs having a greater stretch resistance than any of the three light-duty tension springs, the underside tension springs include a heavy-duty tension spring and a pair of light-duty tension springs, the topside springs include a pair of medium-duty tension springs and a pair of tension springs consisting of one medium-duty tension spring and one light-duty tension spring.

20. The gait assist apparatus of claim 19, wherein each of the heavy-duty tension spring of the underside pair, the light-duty tension spring of the topside pair and one of the remaining two of the medium duty tension springs compressing and stretching in synchronism with each other under some conditions, each of the light-duty tension spring of the underside pair, the medium-duty spring of the topside pair, the further one of the light-duty tension springs, and another of the remaining two of the medium-duty springs compressing and stretching in synchronism with each other under further conditions.

* * * * *